US005205983A

United States Patent [19]

Camp et al.

[11] Patent Number: 5,205,983

[45] Date of Patent: Apr. 27, 1993

[54] ENERGETIC PLASTICIZER AND IMPROVED GAS PRODUCING CHARGES

[75] Inventors: Albert T. Camp, Welcome; Hermann S. Haiss; Paul R. Mosher, both of Indian Head, all of Md.

[73] Assignee: The United States of America as represented by the Secretary of the Navy, Washington, D.C.

[21] Appl. No.: 470,109

[22] Filed: May 13, 1974

[51] Int. Cl.[5] ..... C06B 25/24; C06B 25/14; C06B 25/00

[52] U.S. Cl. ..... 149/97; 149/96; 149/88; 149/102; 149/104; 149/108

[58] Field of Search ..... 149/88, 96, 98, 102, 149/97, 108, 104

[56] References Cited

U.S. PATENT DOCUMENTS

| | | | |
|---|---|---|---|
| 1,999,828 | 4/1935 | Wiggan | 149/88 |
| 2,139,364 | 12/1938 | Groll | 149/96 |
| 3,316,132 | 4/1967 | Lewis | 149/101 |
| 3,356,547 | 12/1967 | Berthmann et al. | 149/102 |
| 3,634,158 | 1/1972 | Camp et al. | 149/88 |
| 4,000,025 | 12/1976 | Johnson et al. | 149/96 |
| 4,214,929 | 7/1990 | Camp et al. | 149/88 |
| 4,507,161 | 3/1985 | Sujansky et al. | 149/104 |

*Primary Examiner*—Edward A. Miller
*Attorney, Agent, or Firm*—Kenneth E. Walden

[57] ABSTRACT

An energetic plasticizer for double base propellants comprising (1) a mixture of sorbitol tetra-,penta-, and hexa-nitrate (MSN) and (2) a polyolpolynitrate selected from the group consisting of diethyleneglycoldinitrate (DEGDN), triethyleneglycoldinitrate (TEGDN), nitroglycerin (NG) and mixtures thereof. Also included are compound formulations for double base, modified double base, and composite modified double base propellants incorporating the above energetic plasticizer.

18 Claims, No Drawings

ENERGETIC PLASTICIZER AND IMPROVED GAS PRODUCING CHARGES

BACKGROUND OF THE INVENTION

This invention relates generally to double base propellant compositions and more particularly to energetic plasticizers for double base propellants.

Solid propellants can be classified as being either homogeneous or composite. The former refers to those types considered true monopropellants in which each molecule contains all the necessary fuel and oxygen for combustion. The composite type propellant, in contrast, consists of a physical mixture of a fuel and an oxidizer. The homogeneous propellants are further subclassified as being either single or double base depending on whether the composition contains a single energetic combustible or contains an additional energetic combustible or a mixture of additional energetic combustibles which act as an energetic plasticizer for the first energetic combustible. Throughout this specification the first energetic combustible is referred to as the polymer, the second energetic combustible as the energetic plasticizer, and the combination of the two as the binder.

Recently, additional oxidizers and metal fuels have been added to double base propellants. If an additional oxidizer(s) is added, the double base propellant is referred to as a modified double base propellant. A double base propellant with an additional oxidier(s) and additional metal fuel(s) is termed composite modified double base propellant. These double base propellants can be considered as hybrids between the homogeneous and composite propellants.

The term plasticization is synomous with gelatinization. It is used to describe the initial physico-chemical reaction of the polymer with the energetic plasticizer. By this reaction, the polymer and the energetic plasticizer form a soft colloidal dispersion. This dispersion is then made usable for propellant purposes by the application of mild heat over a period of time to form a tough, elastic, rubbery solid. This reaction is referred to as curing the propellant composition.

If the polymer is not plasticized by energetic plasticizers, solvents must be used in the processing in order to obtain the colloidal dispersion. Solvent processes always impart a varying amount of residual volatiles in the propellant which cause the energy content to vary accordingly. Further, solvent processes require an objectionally long drying cycle and are not practical for forming most rocket propellant charges.

However, the use of solventless double base propellants has been declining in recent years because of a lack of alternative energetic plasticizer for nitroglycerin. Its extreme sensitivity and high energy make nitroglycerin dangerous to handle and make the resulting propellant composition more sensitive to unwanted detonation. Because of this sensitivity nitroglycerin propellants require a high hazard classification which means extra expense for storage, and a more limited reserve. Other problems arise from the vapors of nitroglycerin. They cause sickness and headaches to humans, thereby causing difficulties in the manufacture, handling, and storage of any nitroglycerin composition. Another troublesome characteristic of nitroglycerin is its tendency to migrate out of composition. This results in a shorter shelf life and a poorer firing accuracy due to variance in propellant energy. Also flame temperatures of a propellant containing nitroglycerin are high. If the propellant is to be used in guns, this characteristic necessitates the addition of coolants which may produce soot and smoke in the exhaust. If coolants are not used, the erosion of the gun barrel is appreciably increased.

Accordingly, much research has been expended since World War II to find alternative energetic plasticizers, or at least a partial substitute for nitroglycerin. Unfortunately the resulting compositions had poor performance or poor mechanical strength or had to rely excessively on solvents for processing. Also the energetic plasticizers other than nitroglycerin had an appreciably lower density and lower energy content or had poor plasticizing capacity for nitrocellulose and other polymers, or were extremely expensive.

Polyolpolynitrates have attracted much attention by researchers. Many of these nitroxy compounds have an energy content, density, and cost comparable to nitroglycerin. But on contact with the various fibrous polymers, very little plasticization occurs. On the other hand, many other polyolpolynitrate plasticize nitrocellulose, but they have a poor energy content.

Homologs of sorbitol nitrate are polyolpolynitrates. Due to the difficulty in preparing these homologs in their pure form, their use in the propellant and explosive arts has been as a mixture of homologs consisting of a large preponderance of the hexa homolog, a small amount of the penta homolog, and traces of the other homologs. These previous mixtures were unable to plasticize nitrocellulose or any other polymer used in propellant and they crystalized easily.

The advantages of the tetra-,penta-, and hexa-sorbitol nitrate mixtures are significant. Their molecules are large and capable of hydrogen bonding. Hence there is little tendency for sorbitol nitrates to migrate out of the propellant composition. Further, the molecular arrangement gives a high density plasticizer, actually as much as 4% denser than NG. These advantages combined with the high energy content and low cost make mixtures of sorbitol nitrates an excellent energetic plasticizer if the plasticizing capacity of this mixture is increased to a practical level.

SUMMARY OF THE INVENTION

Accordingly, an object of this invention is to provide a solventless double base propellant containing little or no nitroglycerin.

Another object of this invention is to provide a double base propellant having a long shelf life.

Another object of this invention is to provide a double base propellant with improved stability.

Still another object of this invention is to provide a double base propellant with high performance consistency.

And another object of this invention is to provide solventless double base propellant with a greater density than present solventless nitroglycerin double base propellant.

And another object of this invention is to provide a solventless double base propellant with excellent mechanical properties.

Also an object of this invention is to provide a safer solventless double base propellant than solventless nitroglycerin double base propellants.

A further object of this invention is to provide a solventless double base propellant with a higher energy content than solventless nitroglycerin double base propellants.

A still further object is to provide an energetic plasticizer for nitrocellulose or similar polymer which is virtually nonvolatile.

These and other objects are achieved by increasing the plasticizing proficiency of a mixture of sorbitol nitrates by the careful selection of the relative amounts of the individual sorbitol nitrates and by the inclusion within a specific range of an additional polyolpolynitrate selected from the group consisting of diethyleneglycoldinitrate (DEDGN), triethyleneglycoldinitrate (TEDGN), nitroglycerin (NG) and mixtures thereof, so that, nitrocellulose or a similar polymer may be sufficiently plasticized to form a double base propellant on a large scale without requiring volatile solvents such as ether, alcohol and acetone in the manufacturing process or requiring a large amount of nitroglycerin in the propellant compound.

DESCRIPTION OF THE PREFERRED EMBODIMENTS

The energetic plasticizer of the invention comprises a mixture of sorbitol nitrates (MSN) and an additional polyolpolynitrate (PPN). Concerning the first component of the energetic plasticizer of this invention, the selection of the individual nitrates and their relative amounts is important. The mixture should comprise almost entirely the sorbitol hexa, penta-, and the tetranitrates in such amounts as to obtain the lowest possible crystalization temperature and greatest plasticization proficiency with the highest energy content and density.

If a plasticizer crystallizes, the propellant is seriously damaged. Pure sorbitol hexanitrate or a mixture with a large amount of this sorbitol nitrate has too high a crystallization temperature to be used in propellants for military and many nonmilitary applications. However, if the percentage of the hexa homolog is kept below twenty weight percent of the sorbitol nitrate mixture (MSN) of this invention, no crystallization has been detected at temperatures as low as −25° C. At these low temperatures, the material merely becomes hard and waxy.

Too much sorbitol pentanitrate in the first component of the energetic plasticizer gives a poor plasticization of the polymer and causes the resulting propellant to be objectionably brittle. On the other hand, an excessive amount of sorbitol tetranitrate reduces the energy content and density of the propellant. Also the resulting propellant is more difficult to process because of high viscosity, caused by hydrogen bonding.

For these reasons, the sorbitol nitrate mixtures of this invention, based on 100 parts by weight of sorbitol nitrate mixture, should comprise (1) from about 10 to about 20 parts of the tetra homolog with a preferred range of 10 to 15 parts, (2) about 60 to about 85 parts of the penta homolog with a preferred range of 70 to 80 parts, and (3) about 5 to about 20 parts of the hexa homolog with a preferred range of 10 to 15 parts. Such mixture would have a nitration range of about 16.8 to about 17.8 percent nitration and a viscosity range of about 150 to about 350 poise at 25° C. for the broad range of sorbitol nitrates and a nitration range of about 17.1 to about 17.4 percent nitration and a viscosity of about 200 to about 250 poise at 25° C. for the preferred range of the sorbitol nitrates.

Preferably the sorbitol nitrate mixture is prepared in the following manner. This process is based on pending Application No. 371,916 filed on Jun. 20, 1973, for the preparation of Pentasorb, a mixture of sorbitol nitrates averaging 5 nitroxy groups per molecule. All of the mixtures of sorbitol nitrate encompassed by this invention may be obtained by varying the concentrations specified in the following process in accordance with the teachings of aforementioned pending application. It is understood that the present invention is not limited to this one process.

A first feed system comprising one mole of sorbitol and 4.33 moles of water and a second feed/stream comprising 7.03 moles of sulfuric acid (100%), 1.95 moles of sulfur trioxide, 2.48 moles of water, and 4.46 moles of nitric acid (100%) are added simultaneously and at a constant rate to a cold (−15° C.) and vigorously stirred mixture in the reactor prepared by cooling a mixture of 3.41 moles of sulfuric acid (100%) and 6.17 moles of nitric acid (100%) to −10° C. before adding 0.1 moles of urea, 7.5 moles of water, and fifteen moles of methylene chloride. After completing the addition, stirring is continued at −10° C. for ten minutes. Then the layers are separated and the methylene chloride solution is washed with an equal volume of ice water. The resulting solution is then washed repeatedly (three washes for ten minutes each) at room temperature with half of its volume of 3% aqueous sodium-carbonate solution followed by an additional water wash. During the water wash any intensive agitation should be avoided since the formation of an emulsion may occur.

For analytical purposes, the crude product can be isolated without further purification by removing the solvent at room temperature by vacuum. The product is a nearly colorless, clear, and viscous fluid with a nitration content of 17.2%.

The purification of the crude product is accomplished by first stripping off the methylene chloride at room temperature and then transferring the crude mixture of sorbitol nitrates to another container. A 2% aqueous sodium bicarbonate solution is added to the crude product. The mixture is then heated under vigorous stirring to 60° C. After two hours the water layer is separated and discarded. An equal portion of fresh wash solution is added and heating is continued for an additional 15 hours after which the wash solution is changed again. After 23 hours the washing procedure is terminated and followed by three water washes at 60° C. (10 minutes each).

After the final water wash the opaque sorbitol nitrate mixture layer is dissolved in a small volume of methylene chloride and the solution dried over sodium sulfate. Finally the solvent is removed in vacuum until weight constance is reached.

The physical characterization of a number of samples of sorbitol nitrate mixture encompassed by this invention are given in Table I.

TABLE I

| $N_2$ Content (%) | Viscosity/25° C. (poise) | Density/25° C. (g/ml) | Refractive Index 25° C. |
|---|---|---|---|
| 17.38 | 202.22 | 1.6678 | 1.4995 |
| 17.36 | 188.84 | — | — |
| 17.52 | 208.84 | — | — |
| 16.96 | 297.77 | 1.6707 | 1.5002 |
| 17.30 | 231.11 | — | — |

Table II gives thermodynamic data on three purified samples of sorbitol nitrate mixtures of this invention. All of the samples in Table I & II were prepared by the previously described process.

TABLE II

| $N_2$ (%) | HOC[1] (cal/gm) | HOE[2] (cal/gm) | HOF[3] (kcal/mole) |
|---|---|---|---|
| 17.00 | −1712 | — | — |
| 17.20 | −1672 | 1603 | 197.62 |
| 17.37 | −1666 | — | — |

The polyolpolynitrate which constitutes the second component of the energetic plasticizer of this invention may be diethyleneglycoldinitrate (DEGDN), triethyleneglycoldinitrate (TEGDN), nitroglycerin (NG), or a mixture of the above. This second component services to augment the plasticizing proficiency of the sorbitol nitrate mixture. If diethyleneglycoldinitrate (DEDGN) is selected, the mininum amount of this nitrate ester which may be added is about 9 weight percent of the total energetic plasticizer weight. Preferably the amount is from about 15 to about 60 weight percent of the total energetic plasticizer weight with a most preferred range of 15 to 30 weight percent of the total energetic plasticizer weight.

If triethyleneglycoldinitrate (TEGDN) is selected, the minimum amount which may be added is about 12 weight percent of the total energetic plasticizer weight. The preferred amount is from about 14 to about 60 weight percent of the total energetic plasticizer weight and the most preferred amount is from 15 to 25 weight percent of the total energetic plasticizer weight.

If nitroglycerin (NG) is selected, the minimum amount which may be added is about 15 weight percent of the total plasticizer weight. The preferred amount is from about 18 to about 50 weight percent of the total energetic plasticizer weight and the most preferred amount is from 20 to 30 weight percent of the total energetic plasticizer weight. If a mixture of the above polyolpolynitrate is used, the amount to be used depends on the polyolpolynitrates selected and their respective amounts. The weight range would simply be the average of the mixture.

A lower limit is given but no upper limit is given because the additional polyolpolynitrates of this invention are themselves plasticizers. Increasing these nitrate esters above the upper limit would only diminish the advantages of the sorbitol nitrate mixture without increasing the advantages of the nitrate esters. This would be especially true with nitroglycerin (NG). The preferred ranges are those ranges which produced propellants with the highest energy and density and with the greatest mechanical strength and elongation capability.

The relative amounts of the polyolpolynitrate and the mixture of sorbitol nitrates (MSN) which constitute the energetic plasticizer of this invention are summarized in Table III. The quanties given are weight percent of the total amount of energetic plasticizer.

TABLE III

| | Broad | Pref. | Most Pref. |
|---|---|---|---|
| MSN | 91% | 40–85% | 70–85% |
| DEGDN | 9% | 15–60% | 15–30% |
| MSN | 88% | 40–86% | 75–85% |
| TEGDN | 12% | 14–60% | 15–25% |
| MSN | 85% | 50–82% | 70–80% |
| NG | 15% | 18–50% | 20–30% |

In compounding homogeneous double base propellant compositions, the amount of the energetic plasticizer encompassed this invention may be from about 35 to about 85 weight percent with the preferred amount from 40 to 80 weight percent and the most preferred amount from 45 to 70 weight percent. Modified double base propellants generally do not require as much energetic plasticizer as do homogeneous double base propellants because of the greatly reduced amount of polymer generally used. The ratio of energetic plasticizer to nitrocellulose (or to total binder) may be much higher however than in homogeneous propellants. The energetic plasticizer of this invention may constitute from about 25 to about 50 weight percent of the total modified double base propellant weight. Preferably the amount of the energetic plasticizer is from 30 to 45 weight percent of the total propellant weight. In compounding composite modified double base propellants, from about 15 to about 40 weight percent of the energetic plasticizer of this invention is included. The preferred amount of this energetic plasticizer is from 25 to 30 weight percent of the total propellant weight.

While preferably the polymer used herein is plastisol nitrocellulose (PNC) with a nitrogen content of 12.6%, plastisol cellulose acetate (PCA) and the like may also be used. If the plastisol form is not used, the resulting propellant cannot be cast but can be solvent mixed, or rolled and extruded by conventional solventless techniques. The amount of the polymer for homogeneous double base propellants may be from about 20 to about 45 weight percent with the preferred amount from 25 to 40 weight percent. Modified double base propellants require less polymer than regular double base propellants. The amount of polymer for modified double base propellants is from about 10 to about 30 weight percent with 12 to 20 weight percent the preferred range. For composite modified double base propellants, the amount of polymer varies from about 4 to about 20 weight percent with a preferred range of 5 to 8 weight percent.

Sufficient plasticization of plastisol nitrocellulose for some application may be obtained with an energetic plasticizer to polymer ratio as low as 1.3 to 1.0. For the higher solids loadings of the composite and composite modified propellants, higher ratios are needed. Generally a ratio of about 3:1 to about 5:1 is selected. If great fluidity in the mix is desired, ratios from about 8:1 to about 9:1 are used, but crosslinking is needed for strength because of the reduced hydrogen bonding found at these ratios.

The use of the energetic plasticizer of this invention does not present any compatibility problems with other art recognized double base ingredients or present any processing problems. Examples of the types of additives commonly incorporated in double base propellants are stabilizers, nonenergetic plasticizers, ballistic modifiers, metal fuels, oxidizers, flash suppressants, and extrusion aids.

Examples of suitable stabilizers which may be used are 2-nitrodiphenylamine (2NDPA), ethyl centralite (EC), and N-methyl paranitroaniline. The stabilizer may constitute from about 0.5 to about 5 weight percent of the total composition weight with about 1 to about 4 weight percent preferred and about 1 to about 2 weight percent the most preferred.

If it is desired to include a nonenergetic plasticizer in addition to the enrgetic one, such art recognized plasticizers as di-n-propyl adipate, triacetin, adiponitrole, triethylene glycol diacepate and diethylphthalate, mixtures thereof, and the like may be used. Usually the amount would be between about 0.5 to about 9.0 weight percent.

A flash depressant may be added such as potassium cryolite in an amount of 0.5 to 3 weight percent.

Examples of possible ballistic modifiers are monobasic cupric β-resorcylate (MCBR), lead-β-resorcylate, lead salicylate, lead o-acetamidobenzoate, and lead 4-oretamindo salicylate, and the like. The amount of each to be added may be from 0.3 to 2.5 weight percent. With the preferred total ballistic modifier content in the range of 0.7 to 5.0 percent.

Other additives which may advantageously be incorporated in a propellant formulation encompassed by the present invention include candelilla wax which in minute quantities facilitates extrusion.

Any of the usual metal fuels may be used with the energetic plasticizer of this invention. The preferred metal fuel is aluminum having a particle size of 10 μ or less. The metal fuel may be between about 1 to about 25 weight percent with a preferred range of 2 to 20 weight percent.

If an oxidizer is wanted, ammonium perchlorate (AP), cyclotetramethylenetetranitramine (HMX), cyclotrimethylenetrinitramine (RDX), mixture thereof or the like may be incorporated into the double base propellant. The preferred oxidizers are ammonium perchlorate (AP), cyclotetramethylenetetranitramine (HMX), and a mixture of the two. The amount of oxidizer may be from about 30 weight percent to about 65 weight percent with a preferred range of 35 to 50 weight percent if substantial aluminum is employed and 40 to 60 weight percent if less than 5% of aluminum is used. Preferably the particle size of the oxidizer is in the range of 5 to 200 microns, but any reasonable combination of particle sizes may be used to achieve the maximum packing fraction of solids.

Since a major advantage of this invention is that a double base propellant of exceptional strength may be prepared by a solventless plastisol process, this process is the preferred method of preparation. By way of example the following process is given. The plastisol nitrocellulose and any aluminum to be used are mixed to a thin slurry in about 5 times their weight of hexane, Desired ballistic modifiers are admixed with the slurry. The mixture of energetic plasticizers is slowly added to the slurry and finally the oxidizers are admixed. Thereafter, the slurry is filtered or centrifuged to remove most of the hexane and the resulting slurry is cast into the final mold and cured for a period of 1 to 5 days or more at a temperature of about 130° F. The method of mixing is not critical, provided that distribution of all ingredients is uniform and no losses of ingredients occur which are not otherwise accounted for. The propellant formed may be machined or extruded into any desired form.

The general nature of the invention having been set forth, the following examples, prepared by the above process, are presented as specific illustrations thereof. The mixture of sorbitol nitrate (MSN) used in the following examples was prepared by the herein-in-before described preparation of MSN. It is under that the invention is not limited to these examples but is susceptible to different modifications that would be recognized by one of ordinary skill in the art.

TABLE IV

| Batch No. | PNC (%) | MSN (%) | TEGDN (%) | DEGDN (%) | TA (%) | ADN (%) | 2-NDPA (%) | MCBR (%) | AB-7 (%) | AS-9[2] (%) | HOE (cal/g) Calc. | HOE (cal/g) Dec. |
|---|---|---|---|---|---|---|---|---|---|---|---|---|
| 1 | 31 | 49 | 9 | — | 6.5 | 2.0 | 1.0 | 1.5 | — | — | 1020 | 1000 |
| 2 | 33 | 45 | 9 | — | 9.0 | 1.5 | 1.0 | 1.5 | — | — | 955 | 958 |
| 3 | 33 | 40 | 10 | — | 12.0 | 1.5 | 2.0 | 1.5 | — | — | 814 | 824 |
| 4 | 36 | 40 | 7 | — | 12.0 | 1.5 | 2.0 | 1.5 | — | — | 826 | 834 |
| 5. | 31 | 48 | 9 | — | 7.0 | 2.0 | 1.0 | 1.0 | 1.0 | — | 991.5 | 980 |
| 6 | 31 | 48 | 9 | — | 7.0 | 2.0 | 1.0 | 1.0 | — | 1.0 | 991.5 | 980 |
| 7 | 31 | 47.5 | 9 | — | 7.0 | 2.0 | 1.0 | 0.5 | — | 2.0 | 973 | 983 |
| 8 | 31 | 48 | 9 | — | 7.0 | 2.0 | 1.0 | 0.5 | 1.5 | — | 989 | 989 |
| 9 | 35 | 42 | 6 | — | 10.0 | 2.5 | 2.0 | 1.0 | 1.5 | — | 830 | 853 |
| 10 | 31 | 48 | — | 9.5 | 6.5 | 2.0 | 1.0 | 1.0 | 1.0 | — | 1014 | 1053 |

[1]AB-7 is lead o-acetamido benzoate
[3]AS-9 is lead 4-acetamide salicylate

In 1 the following table, burning rate data for the above table are presented.

TABLE V

| Batch No. | 1000 psi | 1500 psi | 2000 psi | 2500 psi | 3000 psi | 4000 psi | 5000 psi |
|---|---|---|---|---|---|---|---|
| 1 | 0.347 | 0.471 | 0.544 | — | 0.728 | — | — |
| 2 | 0.338 | 0.436 | 0.484 | — | 0.597 | — | — |
| 3 | 0.257 | — | 0.333 | — | — | — | — |
| 4 | 0.270 | — | 0.394 | — | 0.478 | — | — |
| 5 | 0.588 | 0.677 | 0.715 | — | 0.769 | — | — |
| 6 | 0.563 | 0.657 | 0.709 | 0.743 | 0.765 | 0.917 | 1.114 |
| 7 | 0.521 | 0.600 | 0.639 | 0.670 | 0.734 | 0.904 | 1.117 |
| 8 | 0.545 | 0.631 | 0.660 | 0.705 | 0.782 | 1.005 | 1.164 |
| 9 | 0.564 | 0.604 | 0.632 | 0.644 | 0.649 | 0.717 | 0.801 |
| 10 | 0.588 | 0.692 | 0.759 | 0.877 | 0.870 | 1.075 | 1.271 |

The safety of the propellants of Table IV was tested by three standard tests; the impact test, the friction test, and the electrostatic discharge test. Results of the impact test are reported as the minimum weight and height in kg mm at which a hammer in free fall will cause three consecutive positive explosions. For the propellants of this invention, a five kg hammer was used. The friction test measures the sensitivity of the propellant to friction forces at a velocity of 8 ft/sec. The result is recorded in terms of the maximum force which can be applied without causing the propellant to decompose visibly. The electrostatic discharge test determines the amount of electrostatic charge a material can withstand before igniting or exploding. Here the test was conducted 5000 volts and the results were measured in joules. All of the samples had an impact test result of 100–175 mm, a friction test result of at least 960 lb, and an electrostatic test results of at least 12.5 joules.

It is possible to formulate propellants with higher energy values by increasing the amount of the energetic plasticizer. In Table VI, samples of the more energetic propellants are presented. All of the samples had an impact test result of 100–115 mm, a sliding friction test result of at least 90 lb, and an electrostatic test result of at least 12.5 joules.

TABLE VI

| Batch No. | PNC % | MSN % | DEGDN % | TA % | 2-NDPA % | RES. % | HOE (cal/gm) Calc. | HOE (cal/gm) Det. |
|---|---|---|---|---|---|---|---|---|
| 11 | 30.25 | 48.75 | 11.93 | 6.55 | 1.68 | 0.84 | 1113 | 1048 |
| 12 | 32.50 | 40.5 | 25.0 | — | 1.5 | 0.50 | 1163 | 1123 |
| 13 | 32.5 | 45.5 | 20.0 | — | 1.5 | 0.50 | 1195 | — |
| 14 | 32.5 | 48.0 | 17.5 | — | 1.5 | 0.50 | 1220 | — |
| 15 | 32.5 | 50.5 | 15.0 | — | 1.5 | 0.50 | 1235 | 1208 |

If the amount of nitroglycerin is kept below 20%, the disadvantages of this nitrate ester are minimized to an extent that the resulting propellant would not be objectionable. Table VII presents four such samples. All of the samples have an impact test result of 100–125 mm, a sliding friction test result of at least 960 lbs. and, an electrostatic test result of at least 12.5 joules.

TABLE VII

| Batch No. | PNC % | MSN % | NG % | DEGDN % | ADN % | 2-NDPA % | RES % | HOE (Cal/gm) Calc. | HOE (Cal/gm) Det. |
|---|---|---|---|---|---|---|---|---|---|
| 16 | 30.2 | 47.4 | 17.8 | — | 1.6 | 2.0 | 1.0 | 1200 | |
| 17 | 24.0 | 51.9 | 19.5 | — | 1.6 | 2.0 | 1.0 | 1340 | |
| 18 | 32.9 | 40.66 | 19.37 | 5.45 | — | 1.08 | 0.54 | 1300 | 1315 |
| 19 | 30.2 | 47.4 | 17.8 | 1.45 | 1.6 | 1.0 | 0.5 | | 1267 |

As was earlier noted, the inclusion of the sorbitol nitrate mixture of this invention does not prevent the addition of a solid oxidizer. Table VIII presents a number of such propellants. Again all of the samples have an impact test result of 10–125 mm, a friction test result of at least 906 lb, and an electrostatic test result of at least 12.5 joules.

TABLE VIII

| Batch No. | PNC % | MSN % | DEGDN % | NG % | TA % | ADN % | 2-NDPA % | RES % | HMX % | HOE (Cal/gm) Calc. | HOE (Cal/gm) Det. |
|---|---|---|---|---|---|---|---|---|---|---|---|
| 20 | 18.0 | 29.5 | 5.5 | — | 4.0 | 1.0 | 1.0 | 0.5 | 40.5 | 1141 | — |
| 21 | 18.0 | 29.0 | 7.1 | — | 3.9 | — | 1.0 | 0.5 | 40.5 | 1160 | — |
| 22 | 15.0 | 32.0 | — | — | 5.0 | 1.2 | 1.6 | 1.0 | 40.0 | — | 1100 |
| 23 | 12.0 | 32.0 | — | 12.0 | — | 1.0 | 2.0 | 1.0 | 40.0 | 1300 | 1342 |
| 24 | 18.0 | 25.5 | 3.4 | 12.1 | — | — | 0.6 | 0.4 | 40.0 | 1343 | 1341 |
| 25 | 12.0 | 32.0 | — | 12.0 | — | 1.0 | 0.5 | 0.5 | 42.0 | 1352 | 1356 |

An example of the plasticizer of this invention being compounded with an oxidizer, fuel, and double base ingredients is given in the following table.

TABLE IX

| Batch No. | PNC % | MSN % | NG % | ADN % | HMX 100 % | HMX 10 % | A 10 % | AP 11 % | 2-NDPA % | RES % | HOE (cal/gm) Determined |
|---|---|---|---|---|---|---|---|---|---|---|---|
| 26 | 7.1 | 19.0 | 8.3 | 0.5 | 24.0 | 16.0 | 19.1 | 5.0 | 0.5 | 0.5 | 1755 |

All weight percentages of the components of the compositions in the specification and claims are weight of the entire composition unless specifically stated to be otherwise.

Obviously, many modifications and variations of this invention are possible in light of the above teachings. It is therefore to be understood that within the scope of the appended claims the invention may be practiced otherwise than as specifically described.

What is claimed as new and desired to be secured by Letters Patent of the United States is:

1. As energetic plasticizer for solventless double base propellants comprising, based on total energetic plasticizer weight, (1) from 40 to 86 weight percent of a sorbitol nitrate mixture comprising, based on total sorbitol nitrate mixture weight, (a) from about 10 to about 20 weight percent of sorbitol tetranitrate, (b) from about 60 to about 85 weight percent of sorbitol pentanitrate, and (c) from about 5 to about 20 weight percent of sorbitol hexanitrate; and (2) an additional polyolpolynitrate selected from the group consisting of diethyleneglycoldinitrate, triethyleneglycoldinitrate, nitroglycerin, and mixtures thereof; wherein the amount of said polyolpolynitrate is from 15 to 60 weight percent if diethyleneglycoldinitrate is selected, from 14 to 60 weight percent if triethyleneglycoldinitrate is selected, from 18 to 50 if nitroglycerin is selected, and from 15 to 60 weight percent if a mixture of the polyolpolynitrates is selected.

2. The energetic plasticizer of claim 1 wherein the sorbitol nitrate mixture comprises, based on total sorbitol nitrate mixture weight, from 10 to 15 weight percent of sorbitol tetranitrate, from 70 to 80 weight percent of sorbitol pentanitrate, and from 10 to 15 weight percent of sorbitol hexanitrate.

3. The energetic plasticizer of claim 1 wherein the amount of sorbitol nitrate is 70 to 85 weight percent and the amount of the polyolpolynitrate is 15 to 30 weight percent if diethyleneglycoldinitrate is selected, is 15 to 25 weight percent if triethyleneglycoldinitrate is selected, is 20 to 30 weight percent if nitroglycerin is selected, and 17 to 28 weight percent if a mixture of polyolpolynitrates is selected.

4. In homogeneous double base propellants comprising plastisol nitrocellulose, the improvement comprising using the energetic plasticizer of claim 1 in an amount from about 35 to about 85 weight percent of the total propellant weight.

5. In homogeneous double base propellants comprising plastisol nitrocellulose, the improvement comprising using the energetic plasticizer of claim 1 in an amount of from 45 to 70 weight percent of the total propellant weight.

6. In homogeneous double base propellants comprising plastisol nitrocellulose, the improvement comprising using the energetic plasticizer of claim 3 in an amount of from about 35 to about 85 weight percent of the total propellant weight.

7. In homogeneous double base propellants comprising plastisol nitrocellulose, the improvement comprising using the energetic plasticizer of claim 3 in an amount of from 45 to 70 weight percent of the total propellant weight.

8. In modified double base propellants comprising plastisol nitrocellulose, the improvement comprising using the energetic plasticizer of claim 1 in an amount from about 25 to about 50 weight percent of the total propellant weight.

9. The improvement of claim 8 wherein the energetic plasticizer is used in an amount of from 30 to 45 weight percent of the total propellant weight.

10. In modified double base propellants comprising plastisol nitrocellulose, the improvement comprising using the energetic plasticizer of claim 3 in an amount of from about 25 to about 50 weight percent of the total propellant weight.

11. The improvement of claim 10 wherein the energetic plasticizer is used in an amount of from 30 to 45 weight percent of the total propellant weight.

12. In composite modified double base propellants comprising plastisol nitrocellulose, the improvement comprising using the energetic plasticizer of claim 1 in an amount from about 15 to about 40 weight percent of the total propellant weight.

13. The improvement of claim 12 wherein the energetic plasticizer is used in an amount of from 25 to 35 weight percent of the total propellant weight.

14. In composite modified double base propellants comprising plastisol nitrocellulose, the improvement comprising using the energetic plasticizer of claim 3 in an amount of from 15 to 40 weight percent of the total propellant weight.

15. The improvement of claim 14 wherein the energetic plasticizer is used in an amount of from 25 to 35 weight percent of the total propellant weight.

16. A method of plasticizing plastisol nitrocellulose which comprises admixing the energetic plasticizer of claim 1 with said plastisol nitrocellulose in an energetic plasticizer to plastisol nitrocellulose ratio of at least 1.3:1.0.

17. A method of plasticizing plastisol nitrocellulose which comprises admixing the energetic plasticizer of claim 3 with said plastisol nitrocellulose in an energetic plasticizer to plastisol nitrocellulose ratio of at least 1.3:1.0.

18. The energetic plasticizer of claim 3 wherein the sorbitol nitrate mixture comprises, based on the total sorbitol nitrate mixture weight, from 10 to 15 weight percent of sorbitol tetranitrate, from 70 to 80 weight percent of sorbitol pentanitrate, and from 10 to 15 weight percent of sorbitol hexanitrate.

* * * * *